United States Patent [19]

Imajo

[11] Patent Number: 4,915,067

[45] Date of Patent: Apr. 10, 1990

[54] VALVE OPERATING SYSTEM OF INTERNAL COMBUSTION ENGINE

[75] Inventor: Minoru Imajo, Yokohama, Japan

[73] Assignee: Nissan Motor Co., Ltd., Yokohama, Japan

[21] Appl. No.: 299,545

[22] Filed: Jan. 12, 1989

[30] Foreign Application Priority Data

Jan. 14, 1988 [JP] Japan ..... 63-3570[U]

[51] Int. Cl.[4] ..... F01M 9/10

[52] U.S. Cl. ..... 123/90.34; 184/6.5; 384/397

[58] Field of Search ..... 123/90.33, 90.34, 196 R; 184/6.5; 384/397, 286

[56] References Cited

U.S. PATENT DOCUMENTS

| | | | |
|---|---|---|---|
| 3,201,183 | 8/1965 | Buske | 384/397 |
| 4,537,166 | 8/1985 | Kimura et al. | 123/90.34 |

FOREIGN PATENT DOCUMENTS

| | | | |
|---|---|---|---|
| 1340771 | 9/1963 | France | 384/397 |
| 0025711 | 3/1978 | Japan | 123/90.34 |
| 55-92005 | 12/1978 | Japan . | |
| 60-167103 | 11/1985 | Japan . | |

*Primary Examiner*—Charles J. Myhre
*Assistant Examiner*—Weilun Lo
*Attorney, Agent, or Firm*—Foley & Lardner, Schwartz, Jeffery, Schwaab, Mack, Blumenthal & Evans

[57] ABSTRACT

A valve operating system for an automotive internal combustion engine. The valve operating system is comprised of a plurality of bearing sections formed in a cylinder head of the engine and adapted to rotatably support a camshaft formed with a plurality of bearing journal sections. Each bearing section has a generally cylindrical bearing surface defining a bore in which each camshaft bearing journal section is disposed. The peripheral surface of the camshaft bearing journal section is slidably contactable with the bearing section bearing surface. In a cross-section to which the axis of the bore is perpendicular, the bearing surface has a first diametrical distance in which reaction of a valve spring for an intake or exhaust valve is applied, and a second diametrical distance perpendicular to the above-mentioned direction. The first diametrical distance is smaller than the second diametrical distance, thereby forming larger an oil clearance correponding to the first diametrical distance than an oil clearance corresponding to the second diametrical distance.

5 Claims, 2 Drawing Sheets

VALVE OPERATING SYSTEM OF INTERNAL COMBUSTION ENGINE

BACKGROUND OF THE INVENTION

1. Field of the Invention

This invention relates generally to a valve operating system of an internal combustion engine, and more particularly to improvements in a bearing structure for a camshaft.

2. Description of the Prior Art

A variety of valve operating systems have been hitherto proposed and put into practical use. In typical ones of these, intake and exhaust valves are arranged to open and close upon being driven directly by a camshaft or indirectly through a rocker arm, a swing arm or the like by a camshaft. Such a camshaft is formed with a plurality of bearing journal sections which are rotatably fitted respectively in the bores of bearing sections provided in a cylinder head of an internal combustion engine. Each bore is defined by a bearing surface to which the camshaft bearing journal section is slidably contactable. Each bearing surface and each camshaft bearing journal section is cylindrical such that the cross-section perpendicular to the axis of the bore is accurately circular. The bearing section bearing surface having a diameter slightly larger than that of the camshaft bearing journal section, thereby forming therebetween an oil clearance to be supplied with lubricating oil for forming an oil film.

However, the following difficulties have been encountered in the above-discussed valve operating systems: When an intake or exhaust valve is opened upon lift of a camshaft cam for any engine cylinder, the reaction of a valve spring is applied to the camshaft. When the lift of the camshaft cam is completed, such valve spring reaction which has applied to the camshaft disappears. Accordingly, if there is a larger oil clearance between the bearing section bearing surface and the peripheral surface of the camshaft bearing journal section, the camshaft largely displaces at various diametrical directions, so that the substantial amount of cam lift or lift characteristics of the intake or exhaust valve becomes inaccurate. As a result, in case of a multi-cylinder internal combustion engine, the opening and closing timings of the intake and exhaust valves are different in the respective engine cylinders, thereby deteriorating engine running stability during idling.

If the oil clearance is set extremely small to obtain a high engine running stability during idling, a sufficient oil film cannot be obtained between the bearing section bearing surface and the peripheral surface of the camshaft journal section, thereby failing good lubrication. This will lead to seizure and the like in the engine. Thus, the above-discussed conventional valve operating systems cannot meet the conflicating requirements of obtaining good lubrication and idling stability. This is particularly conspicuous in case the diameter of the camshaft journal section is considerably large.

SUMMARY OF THE INVENTION

It is an object of the present invention to provide an improved valve operating system which can meet conflicting requirements of obtaining good lubrication for a camshaft bearing journal section and obtaining idling stability.

Another object of the present invention is to provide an improved valve operating system in which an oil clearance formed between the bearing surface of a bearing section and the peripheral surface of a camshaft bearing journal section is formed smaller in a direction in which reaction of a valve spring is applied.

According to the present invention, a valve operating system of an internal combustion engine is comprised of a camshaft by which an engine valve such as an intake or exhaust valve is driven. The camshaft has a bearing journal section. Additionally, a bearing section is provided to rotatably support the camshaft. The bearing section has a generally cylindrical bearing surface defining a bore in which the camshaft bearing journal section is disposed. The peripheral surface of the camshaft bearing journal section is slidably contactable with the bearing section bearing surface. The bearing section bearing surface has, in a cross-section to which the axis of the bore is perpendicular, a first diametrical distance in a first direction in which reaction of a valve spring for the engine valve is applied and a second diametrical distance in a second direction perpendicular to the first direction. The first diametrical distance is smaller than the second diametrical distance.

Thus, an oil clearance formed around the camshaft journal section and in the direction of application of the valve spring reaction is formed smaller, and therefore displacement of the camshaft along with opening and closing actions of the engine valve can be suppressed smaller. As a result, accurate lift characteristics and opening and closing timings of the engine valve can be obtained, thereby improving engine running stability particularly during idling in a multi-cylinder internal combustion engine. Although the oil clearance in the direction of valve spring reaction application is smaller, insufficient lubrication can be effectively prevented because lubricating oil for forming oil film is effectively supplied from a larger oil clearance in a direction perpendicular the above direction under rotation of the camshaft.

BRIEF DESCRIPTION OF THE DRAWINGS

In the drawings, like reference numerals designate like parts and elements throughout all the figures, in which.

DETAILED DESCRIPTION OF THE INVENTION

Figure 1:
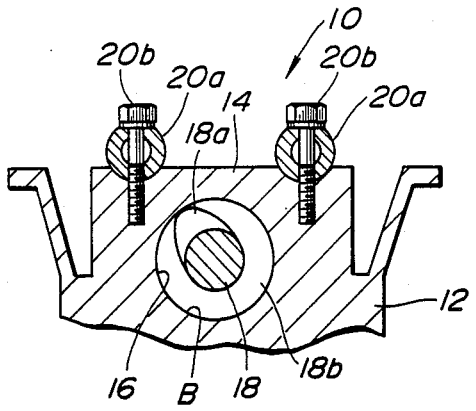
FIG. 1 is a vertical sectional view of a first embodiment of a valve operating system of an internal combustion engine, in accordance with the present invention.
Figure 2:
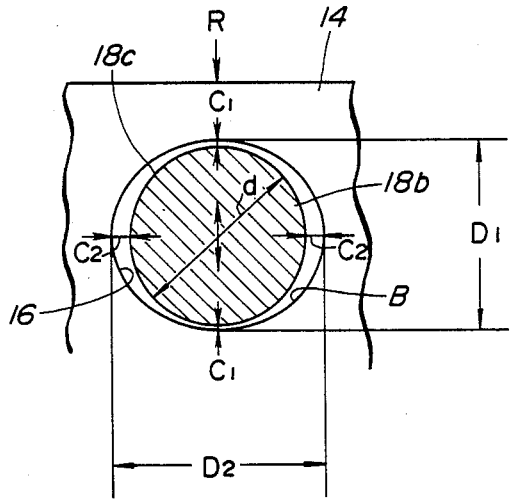
FIG. 2 is a vertical sectional view of an essential part of the valve operating system of FIG. 1.

Referring now to FIGS. 1 and 2, an embodiment of a valve operating system 10 of an internal combustion engine is illustrated by the reference numeral 10. In this embodiment, the engine is of an automotive vehicle. The engine comprises a cylinder head 12 secured to a cylinder block (not shown). The cylinder head 12 is integrally provided with a plurality of partition wall-like bearing sections 14 which upwardly extend and are parallel with each other. Each bearing section 14 is formed with a cylindrical bore B passing therethrough which bore is defined by a generally cylindrical bearing surface 16.

A camshaft 18 is rotatably disposed in the bore B of the bearing section 14 by inserting the camshaft 18 from the side of one end of the cylinder head 12. The camshaft 18 includes cam lobes 18*a* each of which is arranged to drive directly or indirectly an engine valve (not shown) such as an intake or exhaust valve. The camshaft 18 further includes a plurality of bearing journal sections 18*b* each of which is rotatably fitted within the bore B of each bearing section 14 in such a manner as to be in slidable contact with the cylindrical bearing surface 16. In this embodiment, the bearing journal section 18*b* is formed to have a larger diameter.

In this embodiment, the cylindrical bearing surface 16 of each bearing section 14 is formed generally elliptic in a cross-section has a first diametrical distance $D_1$ in a direction R in which reaction of a valve spring (not shown) is applied, and a second diametrical distance $D_2$ in a direction perpendicular to the direction R. In this connection, the bearing journal section 18*b* of the camshaft 18 is accurately circular in a cross-section to which the axis of the camshaft 18 is perpendicular. In other words, the camshaft bearing journal section 18*b* has a constant diameter. As a result, an oil clearance $C_1$ formed in the direction R is smaller than an oil clearance $C_2$ in the direction perpendicular to the direction R. The oil clearance $C_1$, $C_2$ is formed between the bearing surface 16 of the bearing section 14 and the outer peripheral surface 18*c* of the bearing journal section 18*b* of the camshaft 18. Such a bearing surface 16 having the elliptic cross-section can be easily formed by so-called NC (numerical control) machining. In FIG. 1, the reference numeral 20*a* denotes a rocker shaft on which rocker arms (not shown) are swingably moutned. The rocker shaft 20*a* is fixedly secured to the bearing section 14 by a bolt 20*b*.

With the thus arranged valve operating system, when reaction of the valve spring is applied to the camshaft 18 along with the opening and closing actions of the intake and exhaust valves, the oil clearance $C_1$ in the direction of application of the valve spring reaction is smaller, thereby suppressing the diametrical displacement of the camshaft 18 within a very small range. At this time, lubricating oil necessary for oil film formation is supplied by being forced from the larger oil clearance $C_2$ toward the smaller oil clearance $C_1$ under the rotation of the camshaft 18, thus preventing failed lubrication due to absence of oil film between the bearing section bearing surface 16 and the camshaft bearing journal section outer peripheral surface 18*c*. In other words, with this arrangement, it becomes possible to set smaller the oil clerance $C_1$ in the direction of application of valve spring reaction, and therefore the diametrical displacement of the camshaft 18 along with the opening and closing of the intake and exhaust valves can be suppressed smaller. As a result, the required lift characteristics of the intake and exhaust valves can be accurately maintained, thereby preventing disorder of the valve opening and closing timings. This improves engine running stability particularly during idling.

As discussed above, the amount of the valve clearance $C_1$ in the direction of the smaller diametrical distance $D_1$ affects the amount of the displacement of the camshaft 18 and therefore is preferable to be determined such that the displacement, more specifically the displacement of the side of the intake and exhaust valve, becomes within a predetermined range regardless of the diameter d of the camshaft journal section 18*b*. To be concrete, it is preferable that the displacement of the intake and exhaust valve along with displacement of the camshaft 18 is not larger than 0.04 mm. Accordingly, the oil clearance $C_1$ is preferably not larger than 0.03 mm in case in which rocker ratio of a rocker arm for the camshaft cam lobe section 18*a* is 1.3.

Since the oil clearance $C_2$ in the direction of the larger diametrical distance $D_2$ greatly affects lubricating ability for the camshaft 18, the diameter d of the camshaft journal section 18*b* is preferably taken into consideration to make generally constant a clearance ratio s ($s=C_2/d$). To be concrete, the oil clearance $C_2$ is preferably around a value of $d \times (1 \text{ to } 2.5) \times 10^{-3}$ (mm).

Figure 3:
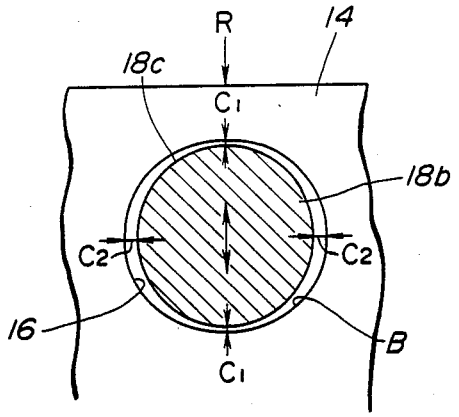
FIG. 3 is a vertical sectional view similar to FIG. 2 but showing an essential part of another embodiment of the valve operating system in accordance with the present invention.

FIG. 3 illustrates an essential part of another embodiment of the valve operating system in accordance with the present invention, which is similar to the first embodiment except for the cross-sectional shape of the bearing surface 16 of the bearing section 14. More specifically, in this embodiment, the radius of curvature of the bearing surface 16 defining the larger oil clearance $C_2$ is generally equal to that of the peripheral surface 18*c* of the camshaft journal section 18*b*. In other words, the bearing surface 16 has a cross-sectional shape of an elongate circle which is formed by shifting the center point of a circle in opposite directions. More specifically, the cross-section of the bearing surface 16 is such that oppositely located two fragments of the cross-sections defining the respective larger oil clearances $C_2$, $C_2$ form respectively parts of circles which have different center points separate from each other. As a result, each oil clearance $C_1$ is formed smaller than the oil clearance $C_2$. It will be understood that such a bearing surface 16 having the elongate circle cross-section can be easily formed by the NC machining.

Figure 4:
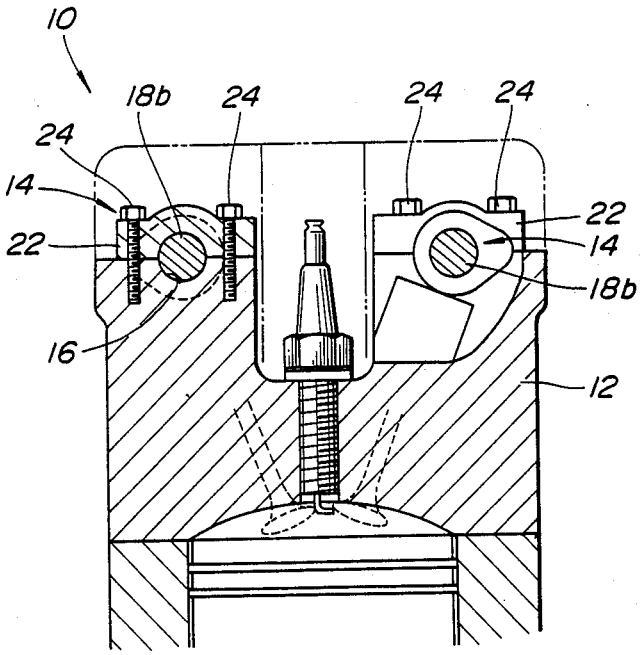
FIG. 4 is a vertical sectional view of a cylinder head, showing a further example of the valve operating system in accordance with the present invention.

While the arrangements of FIGS. 2 and 3 have been shown and/or described as being used in combination with the cylinder head arrangement shown in FIG. 1, it will be understood that they are also used in combination with a cylinder head arrangement as shown in FIG. 4. In FIG. 4, the bearing section 14 formed at the upper section of the cylinder head 12 includes a lower part integral with the cylinder head 12 and an upper part or cam bracket 22. The bearing surface 16 defining the bore for the crankshaft journal section 18*b* is formed throughout the upper and lower parts. The cam bracket 22 is secured onto the bearing section lower part with a pair of bolts 24, 24. Thus, in this example, the bearing surface 16 is elliptic or elongate circle-shaped in the cross-section to which the axis of the bore B of the bearing section 14 while the camshaft journal section 18*b* is accurately circular in the cross-section to which the axis of the bore B is perpendicular.

It will be understood that the bearing section bearing surface 16 elliptic or elongate circle-shaped may be formed by inserting a separate member having a cresent shaped cross-section to be located in the direction of application of valve spring reaction on the bearing surface (16) which is the accurate circle-shaped in cross-section, thus making smaller the oil clearance in the direction of application of valve spring reaction.

What is claimed is:

1. A valve operating system of an internal combustion engine, comprising:

a camshaft by which an engine valve is driven, said camshaft having a bearing journal section; and a bearing section for rotatably supporting said camshaft, said bearing section having a generally cylindrical bearing surface defining a bore in which said camshaft bearing journal section is disposed, the peripheral surface of said camshaft bearing journal section being slidably contactable with said bearing section bearing surface, said generally cylindrical bearing surface having, in a cross-section to which a central longitudinal axis of said camshaft is perpendicular, a first diametrical distance in a first direction in which reaction of a valve spring for the engine valve is applied, and a second diametrical distance in a second direction perpendicular to the first direction, said first diametrical distance being smaller than said second diametrical distance.

2. A valve operating system of an internal combustion engine, comprising:

a camshaft by which an engine valve is driven, said camshaft having a bearing journal section;

a bearing section for rotatably supporting said camshaft, said bearing section having a generally cylindrical bearing surface defining a bore in which said camshaft bearing journal section is disposed, the peripheral surface of said camshaft bearing journal section being slidably contactable with said bearing section bearing surface, said generally cylindrical bearing surface having, in a cross-section to which a central longitudinal axis of said camshaft is perpendicular, a first diametrical distance in a first direction in which reaction of a valve spring for the engine valve is applied, a second diametrical distance in a second direction perpendicular to the first direction, said first diametrical distance being smaller than said second diametrical distance; and means defining first and second oil clearances formed between said bearing section bearing surface and said camshaft journal section peripheral surface, said first and second oil clearances respectively corresponding to first and second diametrical distances, said first oil clearance being smaller than said second oil clearance.

3. A valve operating system as claimed in claim 1, wherein said camshaft bearing journal is accurately circular in a cross-section to which the axis of the bore is perpendicular so as to be constant in diameter throughout the whole periphery of said bearing journal.

4. A valve operating system as claimed in claim 1, wherein said bearing section bearing surface is generally elliptic in the cross-section.

5. A valve operating system as claimed in claim 1, wherein said bearing section bearing surface is generally elongate circle-shaped in the cross-section, in which radius of curvature of said bearing surface corresponding to said second diametrical distance is the same as that of said camshaft bearing journal section.

* * * * *